US010935906B2

(12) United States Patent
Ohnishi et al.

(10) Patent No.: US 10,935,906 B2
(45) Date of Patent: Mar. 2, 2021

(54) DEVELOPER SUPPLY DEVICE AND IMAGE FORMING APPARATUS INCORPORATING SAME

(71) Applicants: Masashi Ohnishi, Kanagawa (JP); Tetsuo Suzuki, Kanagawa (JP); Shingo Kuboki, Kanagawa (JP)

(72) Inventors: Masashi Ohnishi, Kanagawa (JP); Tetsuo Suzuki, Kanagawa (JP); Shingo Kuboki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/887,995

(22) Filed: May 29, 2020

(65) Prior Publication Data

US 2021/0018861 A1 Jan. 21, 2021

(30) Foreign Application Priority Data

Jul. 16, 2019 (JP) ..... JP2019-130869

(51) Int. Cl.
*G03G 15/08* (2006.01)

(52) U.S. Cl.
CPC ..... *G03G 15/0886* (2013.01); *G03G 15/0868* (2013.01)

(58) Field of Classification Search
CPC ..... G03G 15/0865; G03G 15/0867; G03G 15/0886; G03G 21/1647; G03G 21/1842
USPC ..... 399/107, 110, 119, 252, 258, 260, 262
See application file for complete search history.

(56) References Cited

U.S. PATENT DOCUMENTS

| | | | | |
|---|---|---|---|---|
| 8,867,966 | B2 * | 10/2014 | Acosta | G03G 21/1642 399/258 |
| 10,241,439 | B2 * | 3/2019 | Wakimoto | G03G 15/502 |
| 2015/0248107 | A1 | 9/2015 | Hamada et al. | |
| 2015/0268626 | A1 | 9/2015 | Saito et al. | |
| 2016/0004184 | A1 | 1/2016 | Kikuchi et al. | |
| 2016/0306300 | A1 | 10/2016 | Hamada et al. | |
| 2016/0342134 | A1 | 11/2016 | Shiori et al. | |

(Continued)

FOREIGN PATENT DOCUMENTS

| | | |
|---|---|---|
| JP | 2002-268357 | 9/2002 |
| JP | 2003-114568 | 4/2003 |
| JP | 2003-316138 | 11/2003 |

(Continued)

*Primary Examiner* — Hoan H Tran
(74) *Attorney, Agent, or Firm* — Oblon, McClelland, Maier & Neustadt, L.L.P.

(57) ABSTRACT

A developer supply device includes a body, a developer supply unit drawably insertable into the body, and a developer container removably installable in the developer supply unit. The developer container contains a developer and includes a developer discharge port. The developer supply unit includes a lever that closes the developer discharge port when the lever has moved to a first position and opens the developer discharge port when the lever has moved to a second position, and a lock that engages an engagement portion of the lever in conjunction with an operation of drawing the developer supply unit from the body to restrict the lever from moving from the first position to the second position and disengage from the engagement portion in conjunction with an operation of inserting the developer supply unit into the body to allow the lever to move from the first position to the second position.

8 Claims, 7 Drawing Sheets

(56) References Cited

U.S. PATENT DOCUMENTS

| | | | |
|---|---|---|---|
| 2017/0068184 | A1 | 3/2017 | Kikuchi et al. |
| 2017/0212449 | A1 | 7/2017 | Kuboki et al. |

FOREIGN PATENT DOCUMENTS

| | | |
|---|---|---|
| JP | 2005-037633 | 2/2005 |
| JP | 2010-197869 | 9/2010 |

* cited by examiner

DEVELOPER SUPPLY DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2019-130869, filed on Jul. 16, 2019, in the Japan Patent Office, the entire disclosure of which is hereby incorporated by reference herein.

BACKGROUND

Technical Field

Embodiments of the present disclosure generally relate to a developer supply device, in which a developer container is removably installed, and an image forming apparatus, such as a copier, a printer, a facsimile machine, or a multifunction peripheral (MFP) having at least two of such capabilities, incorporating the developer supply device. The developer container contains a developer such as toner therein.

Description of the Related Art

There are image forming apparatuses, such as copiers, printers, and the like, in which a developer supply unit is removably installed.

SUMMARY

Embodiments of the present disclosure describe an improved developer supply device that includes a body, a developer supply unit that is drawably insertable into the body, and a developer container that is removably installable in the developer supply unit. The developer container contains a developer and includes a developer discharge port. The developer supply unit includes a lever and a lock. The lever is configured to close the developer discharge port of the developer container installed in the developer supply unit when the lever has moved to a first position, and open the developer discharge port of the developer container installed in the developer supply unit when the lever has moved from the first position to a second position. The lever includes an engagement portion. The lock is configured to engage the engagement portion in conjunction with an operation of drawing the developer supply unit from the body to restrict the lever from moving from the first position to the second position, and to disengage from the engagement portion in conjunction with an operation of inserting the developer supply unit in the body to allow the lever to move from the first position to the second position.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
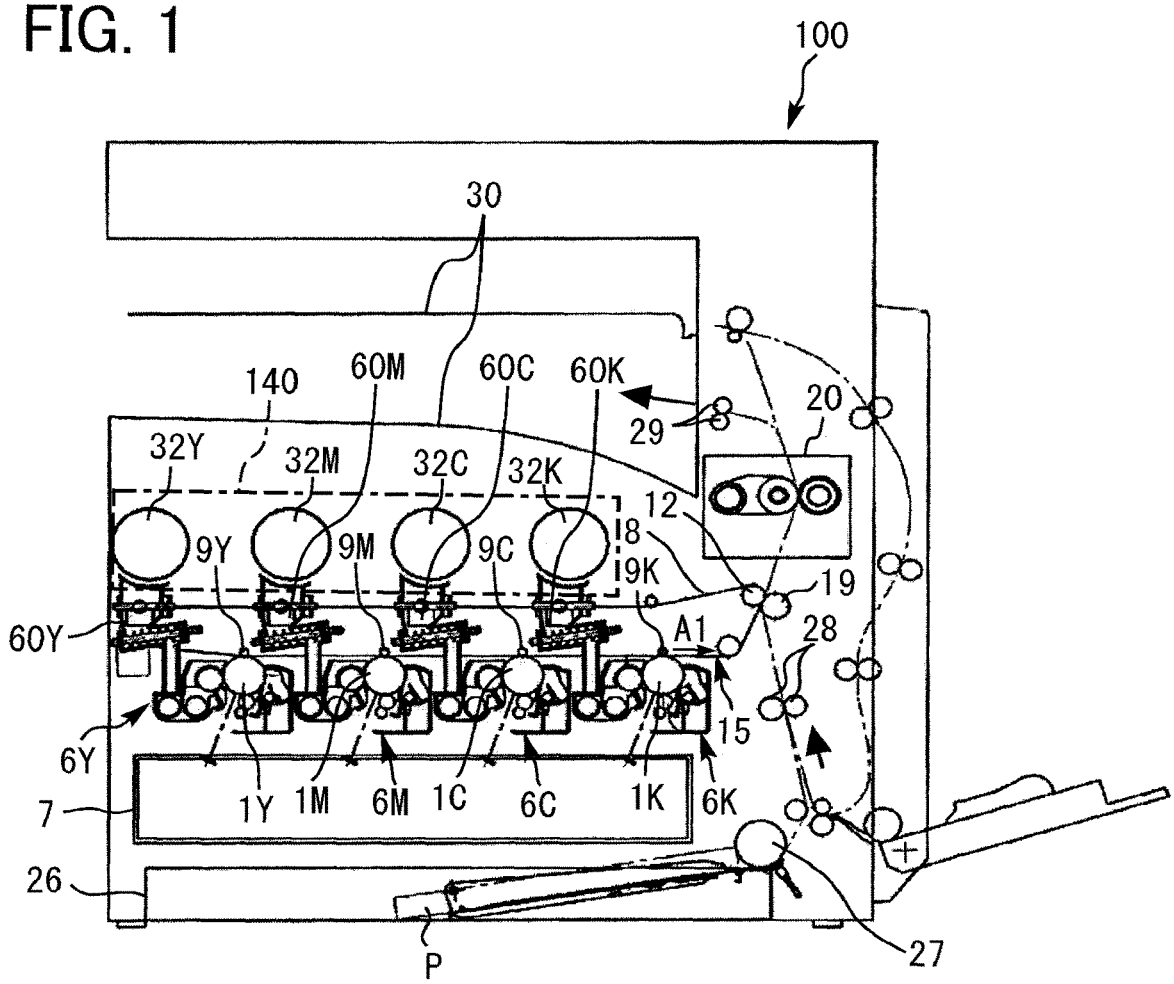
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views, and redundant descriptions are omitted or simplified below as required.

DETAILED DESCRIPTION

Embodiments of the present disclosure are described in detail with reference to drawings.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

A configuration and operation of an image forming apparatus 100 according to the present embodiments is described below.

As illustrated in FIG. 1, in an upper part of the image forming apparatus 100, four toner containers 32Y, 32M, 32C, and 32K as developer containers respectively corresponding to yellow, magenta, cyan, and black are removably installed in toner supply devices 60Y, 60M, 60C, and 60K, respectively. An intermediate transfer unit 15 is disposed at the center of the image forming apparatus 100. Image forming units 6Y, 6M, 6C, and 6K are arranged side by side, facing an intermediate transfer belt 8 of the intermediate transfer unit 15 to form toner images of yellow, magenta, cyan, and black, respectively. Toners as a developer contained in the toner containers 32Y, 32M, 32C, and 32K are supplied to developing devices of the image forming units 6Y, 6M, 6C, and 6K by the toner supply devices 60Y, 60M, 60C, and 60K as developer supply devices, respectively.

Figure 2:
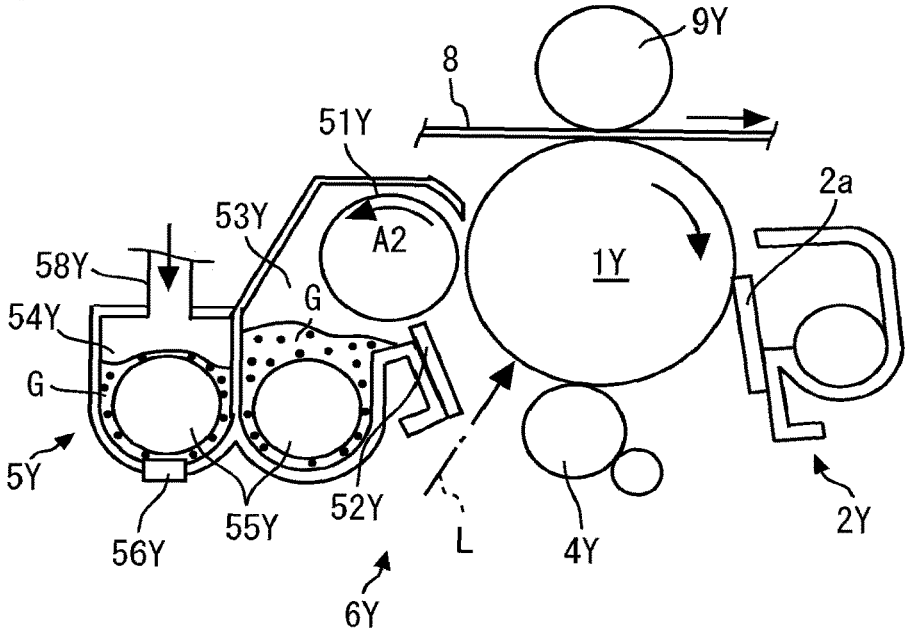
FIG. 2 is a cross-sectional view of an image forming unit of the image forming apparatus in FIG. 1.

With reference to FIG. 2, it can be seen that the image forming unit 6Y for yellow includes a photoconductor drum 1Y as an image bearer, and further includes a charging device 4Y, a developing device 5Y, a cleaning device 2Y, a discharge device, and the like disposed around the photoconductor drum 1Y. Image forming processes, namely, charging, exposure, development, transfer, cleaning, and discharging processes, are performed on the photoconductor drum 1Y, and thus a yellow toner image is formed on the surface of the photoconductor drum 1Y.

The other three image forming units 6M, 6C, and 6K have a similar configuration to that of the image forming unit 6Y for yellow except for the color of toner used therein and form magenta, cyan, and black toner images, respectively. Therefore, only the image forming unit 6Y for yellow is described below and descriptions of the other three image forming units 6M, 6C, and 6K are omitted to avoid redundancy.

As illustrated in FIG. 2, the photoconductor drum 1Y is rotated clockwise in FIG. 2 by a drive motor. The charging device 4Y uniformly charges the surface of the photoconductor drum 1Y (charging process). When the surface of the photoconductor drum 1Y reaches a position where the surface of the photoconductor drum 1Y is irradiated with a laser beam L emitted from an exposure device 7 (see FIG. 1), the photoconductor drum 1Y is scanned with the laser beam L, and thus an electrostatic latent image for yellow is formed thereon (exposure process).

Then, the surface of the photoconductor drum 1Y reaches a position opposite the developing device 5Y, where the electrostatic latent image is developed with toner into a yellow toner image (development process). When the surface of the photoconductor drum 1Y carrying the toner image reaches a position opposite a primary transfer roller 9Y via the intermediate transfer belt 8, the toner image on the photoconductor drum 1Y is transferred onto the intermediate transfer belt 8 (primary transfer process). After the primary transfer process, a certain amount of untransferred toner remains on the photoconductor drum 1Y.

When the surface of the photoconductor drum 1Y reaches a position opposite the cleaning device 2Y, a cleaning blade 2*a* of the cleaning device 2Y mechanically collects the untransferred toner on the photoconductor drum 1Y (cleaning process). Subsequently, the surface of the photoconductor drum 1Y reaches a position opposite the discharge device, and the discharge device removes any residual electric potential from the photoconductor drum 1Y (discharging process) to complete a sequence of image forming processes performed on the photoconductor drum 1Y.

The above-described image forming processes are performed in the image forming units 6M, 6C, and 6K similarly to the image forming unit 6Y for yellow. That is, the exposure device 7 disposed below the image forming units 6M, 6C, and 6K irradiates photoconductor drums 1M, 1C, and 1K of the image forming units 6M, 6C, and 6K with the laser beams L based on image data. Then, the toner images formed on the photoconductor drums 1Y, 1M, 1C, and 1K through the development process are transferred therefrom and superimposed on the intermediate transfer belt 8. Thus, a multicolor toner image is formed on the intermediate transfer belt 8.

With reference to FIG. 1, it can be seen that the intermediate transfer unit 15 includes the intermediate transfer belt 8, four primary transfer rollers 9Y, 9M, 9C, and 9K, a secondary-transfer backup roller 12, multiple tension rollers, a belt cleaning device, and the like. The intermediate transfer belt 8 is stretched around and supported by the multiple rollers and is rotated in the direction indicated by arrow A1 illustrated in FIG. 1 as one of the multiple rollers that serves as a drive roller rotates (i.e., the secondary-transfer backup roller 12).

The four primary transfer rollers 9Y, 9M, 9C, and 9K are pressed against the corresponding photoconductor drums 1Y, 1M, 1C, and 1K, respectively, via the intermediate transfer belt 8 to form primary transfer nips. A primary-transfer bias opposite in polarity to toner is applied to the primary transfer rollers 9Y, 9M, 9C, and 9K. While rotating in the direction indicated by arrow A1 in FIG. 1, the intermediate transfer belt 8 passes through the primary transfer nips between the photoconductor drums 1Y, 1M, 1C, and 1K and the respective four primary transfer rollers 9Y, 9M, 9C, and 9K. Then, the single-color toner images on the photoconductor drums 1Y, 1M, 1C, and 1K are primarily transferred to and superimposed on the intermediate transfer belt 8, thereby forming the multicolor toner image.

Subsequently, the intermediate transfer belt 8 carrying the multicolor toner image reaches a position opposite a secondary transfer roller 19. At this position, the secondary-transfer backup roller 12 and the secondary transfer roller 19 press against each other via the intermediate transfer belt 8, thereby forming a secondary transfer nip. The multicolor toner image on the intermediate transfer belt 8 is transferred onto a sheet P such as a paper sheet transported to the secondary transfer nip (secondary transfer process). At that time, untransferred toner that is not transferred onto the sheet P remains on the surface of the intermediate transfer belt 8.

The surface of the intermediate transfer belt 8 then reaches a position opposite the belt cleaning device, and the untransferred toner is collected from the intermediate transfer belt 8 to complete a series of image transfer processes performed on the intermediate transfer belt 8.

The sheet P is transported from a sheet feeder 26 disposed in a lower portion of the image forming apparatus 100 to the secondary transfer nip via a sheet feeding roller 27 and a registration roller pair 28. Specifically, the sheet feeder 26 contains a stack of multiple sheets P such as paper sheets piled one on another. As the sheet feeding roller 27 rotates counterclockwise in FIG. 1, the sheet feeding roller 27 feeds a top sheet P from the stack in the sheet feeder 26 to a roller nip between the registration roller pair 28.

The registration roller pair 28 stops rotating temporarily, stopping the sheet P with a leading edge of the sheet P nipped in the registration roller pair 28. Then, the registration roller pair 28 rotates to transport the sheet P to the secondary transfer nip, timed to coincide with the arrival of the multicolor toner image on the intermediate transfer belt 8, and the secondary transfer roller 19 transfers the desired multicolor toner image onto the sheet P.

Subsequently, the sheet P, onto which the multicolor image is transferred at the secondary transfer nip, is transported to a fixing device 20. In the fixing device 20, a fixing belt and a pressure roller apply heat and pressure to the sheet P to fix the multicolor toner image on the sheet P. Subsequently, the sheet P is ejected by an output roller pair 29 to the exterior of the image forming apparatus 100. The sheets P ejected by the output roller pair 29 are sequentially stacked as output images on a stack tray 30 to complete a sequence of image forming processes performed in the image forming apparatus 100.

Next, a description is provided of the configuration and operation of the developing device 5Y in further detail with reference to FIG. 2.

The developing device 5Y includes a developing roller 51Y disposed opposite the photoconductor drum 1Y, a doctor blade 52Y disposed opposite the developing roller 51Y, two conveying screws 55Y disposed in developer-containing compartments 53Y and 54Y, and a toner concentration sensor 56Y to detect concentration of toner in a developer G. The developing roller 51Y includes stationary magnets therein, a sleeve that rotates around the magnets, and the like. The developer-containing compartments 53Y and 54Y contain the two-component developer G including carrier and toner. The developer-containing compartment 54Y communicates, via an opening on an upper side thereof, with a downward toner passage 58Y.

The developing device 5Y operates as follows. The sleeve of the developing roller 51Y rotates in the direction indicated by arrow A2 illustrated in FIG. 2. The developer G is carried on the developing roller 51Y by a magnetic field generated by the magnets. As the sleeve rotates, the developer G moves along the circumference of the developing roller 51Y.

The percentage (concentration) of toner in the developer G (ratio of toner to carrier) in the developing device 5Y is constantly adjusted within a predetermined range. More specifically, the toner supply device 60Y (see FIG. 3A) supplies toner from the toner container 32Y to the developer-containing compartment 54Y as the toner in the developing device 5Y is consumed to maintain a constant concentration. The configuration and operation of the toner supply device 60Y are described in detail later.

The two conveying screws 55Y stir and mix the developer G with the toner supplied to the developer-containing compartment 54Y while circulating the developer G in the developer-containing compartments 53Y and MY. In this case, the developer G moves in the direction perpendicular to the surface of the paper on which FIG. 2 is drawn. The toner in developer G is triboelectrically charged by friction with the carrier and electrostatically attracted to the carrier. Then, the toner is carried on the developing roller 51Y together with the carrier by magnetic force generated on the developing roller 51Y.

The developer G carried on the developing roller 51Y is transported in the direction indicated by arrow A2 illustrated in FIG. 2 to the doctor blade 52Y. The amount of developer G on the developing roller 51Y is adjusted by the doctor blade 52Y, after which the developer G is transported to a development range opposite the photoconductor drum 1Y. The toner in the developer G is attracted to the electrostatic latent image formed on the photoconductor drum 1Y due to the effect of an electric field generated in the development range. As the sleeve rotates, the developer G remaining on the developing roller 51Y reaches an upper part of the developer-containing compartment 53Y and separates from the developing roller 51Y.

Next, the toner containers 32Y, 32M, 32C, and 32K as the developer containers are described with reference to FIG. 3A. The respective color toners in the toner containers 32Y, 32M, 32C, and 32K installed in the image forming apparatus 100 are supplied to the corresponding developing devices of the image forming units 6Y, 6M, 6C, and 6K by the toner supply devices 60Y, 60M, 60C, and 60K provided for the respective color toners according to the amount of toner consumed in the corresponding developing devices.

It is to be noted that the four toner supply devices 60Y, 60M, 60C, and 60K have a similar structure, and the four toner containers 32Y, 32M, 32C, and 32K have a similar structure except for the color of toner used in the image forming processes. Therefore, only the toner supply device 60Y and the toner container 32Y for yellow are described below as representatives, and descriptions of the toner supply devices 60M, 60C, and 60K and the toner containers 32M, 32C, and 32K for the other three colors are omitted to avoid redundancy.

Figure 3A:
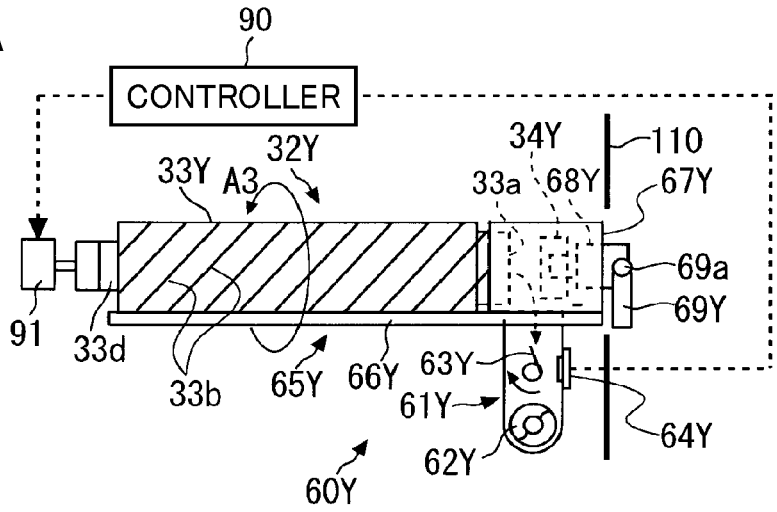
FIGS. 3A to 3C are schematic views illustrating an operation of drawing a toner supply unit from a toner supply device of the image forming apparatus in FIG. 1.

As illustrated in FIG. 3A, the toner container 32Y includes a substantially cylindrical container body 33Y and a cap 34Y detachably attached to a toner discharge port 33*a* of the container body 33Y. The container body 33Y of the toner container 32Y contains toner as a developer. The substantially cylindrical container body 33Y includes the toner discharge port 33*a* as a developer discharge port and a coupling 33*d*. The toner discharge port 33*a* is disposed at the head of the container body 33Y to discharge toner outside the container body 33Y. The coupling 33*d* is disposed at the bottom of the container body 33Y to rotate along with the container body 33Y. The coupling 33*d* meshes with a drive coupling disposed on a motor shaft of a drive motor 91 of the toner supply device 60Y (the image forming apparatus 100) to rotate the container body 33Y. The driving force of the drive motor 91 controlled by a controller 90 is transmitted to the coupling 33*d* to rotate the container body 33Y in the direction indicated by arrow A3 in FIG. 3A.

A helical rib 33*b* protruding inward is formed on the inner circumferential face of the container body 33Y. In other words, a helical groove is formed on the outer circumferential face of the container body 33Y when viewed from outside. The helical rib 33*b* is for discharging toner contained in the container body 33Y through the toner discharge port 33*a*. As the container body 33Y rotates around the rotation axis extending in the longitudinal direction of the container body 33Y, the helical rib 33*b* transports the toner toward the toner discharge port 33*a*. Note that the toner container 32Y is replaced with a new one when the service life thereof has expired, that is, when almost all toner contained in the toner container 32Y has been depleted.

Next, the toner supply device 60Y (, 60M, 60C, and 60K) as the developer supply device is described with reference to FIG. 3A. As illustrated in FIG. 3A, the toner supply device 60Y mainly includes a toner tank 61Y and a toner supply unit (drawing unit) 65Y as a developer supply unit. The toner supply unit 65Y includes a container body mount 66Y and a cap holder 67Y. The cap holder 67Y includes a chuck 68Y, a lever 69Y, and the like. The toner container 32Y is placed on the container body mount 66Y with the head of the toner container 32Y inserted in the cap holder 67Y. The cap 34Y is detachably attached to the container body 33Y by the chuck 68Y inside the cap holder 67Y. The cap holder 67Y communicates with the toner tank 61Y, and toner discharged from the toner discharge port 33*a* of the toner container 32Y (the container body 33Y) with the cap 34Y detached flows into the toner tank 61Y via the cap holder 67Y. As the lever 69Y is manually operated in a state in which the toner container 32Y is set in the toner supply unit 65Y (the toner supply device 60Y), the cap 34Y is detached from the container body 33Y by the chuck 68Y.

From FIG. 3A, a toner conveying screw 62Y, a stirrer 63Y, and a toner end sensor 64Y are disposed in the toner tank 61Y. The toner tank 61Y is disposed below the toner discharge port 33*a* of the toner container 32Y and stores the toner discharged from the toner discharge port 33*a* of the toner container 32Y. A bottom of the toner tank 61Y is coupled to an upstream side of the toner conveying screw 62Y in the direction in which the toner is conveyed.

The toner end sensor 64Y is disposed on a side wall of the toner tank 61Y at a predetermined height from the bottom and detects that the amount of toner stored in the toner tank 61Y has fallen below a predetermined amount. For example, a piezoelectric sensor can be used as the toner end sensor 64Y. When the controller 90 recognizes that the amount of toner stored in the toner tank 61Y is less than the predetermined amount using the toner end sensor 64Y, the controller 90 causes the drive motor 91 to rotate the container body 33Y of the toner container 32Y for a predetermined period, thereby supplying toner to the toner tank 61Y. If the toner end sensor 64Y continues to report "toner end" even when this operation is repeated for a predetermined number of times, the controller 90 recognizes that the toner container 32Y is empty (toner depletion). Then, the controller 90 causes a control panel of the image forming apparatus 100 to prompt a user to replace the toner container 32Y.

The stirrer 63Y is disposed at the center of the toner tank 61Y (near the toner end sensor 64Y) to prevent agglomeration of the toner stored in the toner tank 61Y. The stirrer 63Y includes a shaft and a flexible member disposed on the shaft. The stirrer 63Y rotates clockwise in FIG. 3A to stir the toner in the toner tank 61Y. The tip of the flexible member of the stirrer 63Y slidingly contacts the surface where the toner end sensor 64Y detects in rotation cycles. As a result, the toner does not adhere to the surface where the toner end sensor 64Y detects, thereby preventing the detection accuracy from deteriorating.

The toner conveying screw 62Y conveys the toner stored in the toner tank 61Y obliquely upward. Specifically, the toner conveying screw 62Y conveys the toner linearly from the bottom (the lowest point) of the toner tank 61Y to the point above the developing device 5Y. Then, the toner conveyed by the toner conveying screw 62Y falls in the downward toner passage 58Y (see FIG. 2) under gravity and is supplied into the developing device 5Y (the developer-containing compartment 54Y).

Hereinafter, the configuration and operation of the toner supply device 60Y (, 60M, 60C, and 60K) as the developer supply device in the present embodiment is described in detail with reference to FIGS. 3A to 11. Note that, in FIGS. 4 to 11, illustration of the toner container 32Y and the like is omitted for simplicity.

As described above with reference to FIG. 3A, the replaceable toner container 32Y as the developer container is removably installed in the toner supply unit 65Y as the developer supply unit in the present embodiment. The toner supply unit 65Y is drawably inserted (or removably installed) in a body 60*a* (see FIG. 3C) of the toner supply device 60Y as the developer supply device.

Figure 3B:
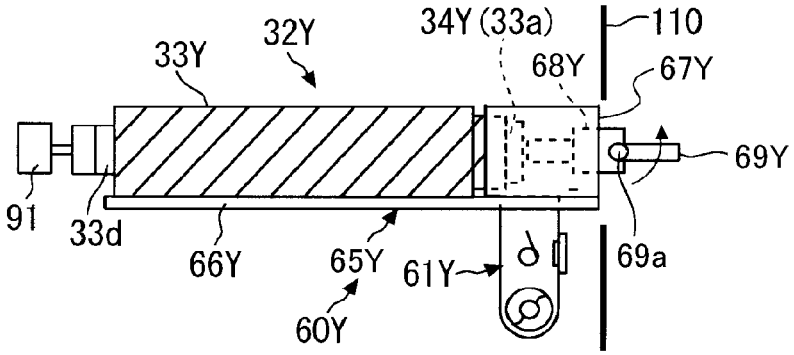
Figure 3C:
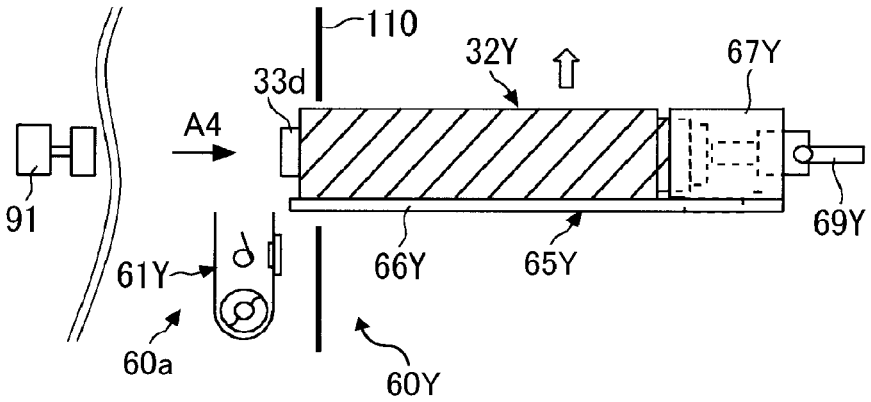

More specifically, as a body cover 140 (see FIG. 1) of the image forming apparatus 100 is opened, the cap holder 67Y of the toner supply unit 65Y is exposed. The body cover 140 is disposed on the front side of the image forming apparatus 100 in the direction perpendicular to the surface of the paper on which FIG. 1 is drawn or in the direction to insert the toner supply unit 65Y (hereinafter, referred to as a "unit insertion direction"). As illustrated in FIGS. 3A to 3C, as the toner supply unit 65Y in which the toner container 32Y is set is pulled out rightward from the body 60*a* of the toner supply device 60Y along a rail portion of the toner supply device 60Y as indicated by arrow A4 in FIG. 3C, the toner container 32Y is upwardly exposed outside the image forming apparatus 100. That is, an operator moves the lever 69Y from the tilted state as illustrated in FIG. 3A to the upright state as illustrated in FIG. 3B (i.e., the operator rotates the lever 69Y counterclockwise around a support shaft 69*a*), after which the operator draws the toner supply unit 65Y while grasping the lever 69Y. At that time, the coupling between the toner supply unit 65Y and the toner tank 61Y is released, and the coupling 33*d* of the toner container 32Y is disengaged from the drive coupling of the drive motor 91. Then, the operator removes the toner container 32Y, in the direction indicated by the blank arrow in FIG. 3C, from the toner supply unit 65Y pulled out to the right. When a new toner container 32Y is set in place of the removed toner container 32Y, which is empty, the operator performs a procedure reverse to the above-described procedure. Thus, the toner container 32Y is replaced as described above.

Figure 4:
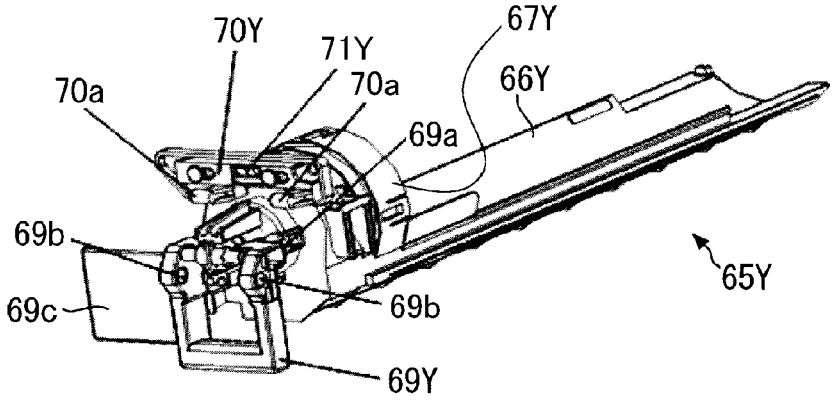
FIG. 4 is a perspective view of the toner supply unit in FIGS. 3A to 3C.
Figure 5A:
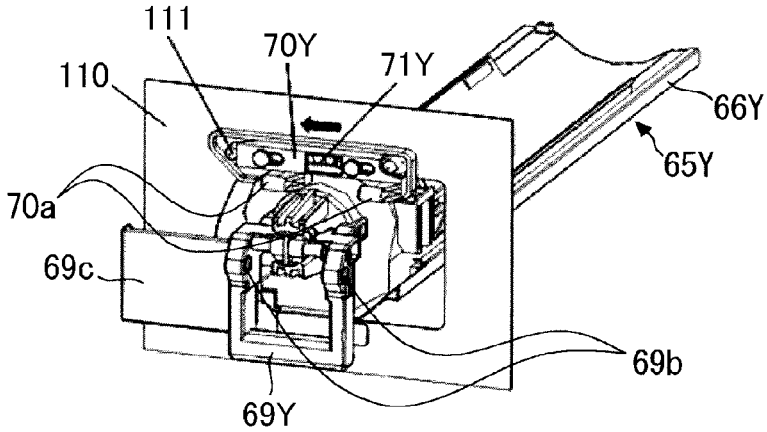
FIGS. 5A and 5B are perspective views illustrating an operation of a lever and a lock of the toner supply unit when the toner supply unit is drawn.
Figure 5B:
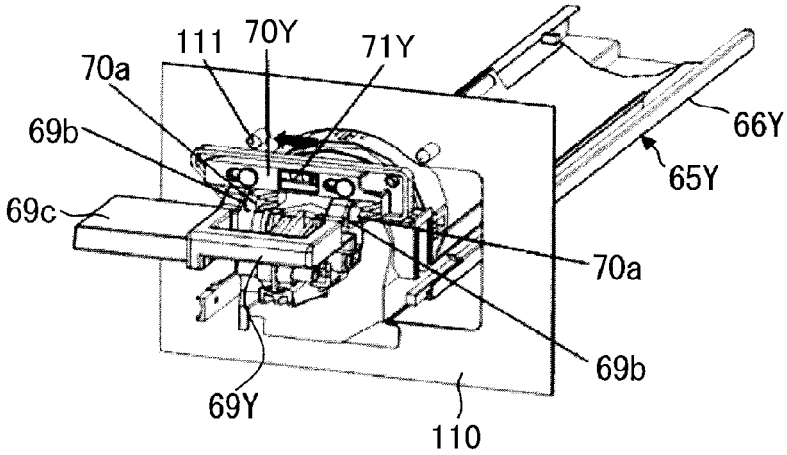

With reference to FIGS. 4, 5A, and 5B, in the present embodiment, the toner supply unit 65Y as the developer supply unit includes the lever 69Y and a lock 70Y. The lever 69Y opens and closes the toner discharge port 33*a* of the toner container 32Y (the container body 33Y). The lock 70Y restricts the lever 69Y from rotating. When the lever 69Y moves (rotates) to a first position illustrated in FIGS. 3B, 5B, and 6, the toner discharge port 33*a* of the toner container 32Y installed in the toner supply unit 65Y is closed. When the lever 69Y moves (rotates) from the first position to a second position illustrated in FIGS. 3A, 4, and 5A, the toner discharge port 33*a* is opened.

Specifically, the lever 69Y is disposed on the head of the cap holder 67Y (on the front side in the unit insertion direction) and rotatable around the support shaft 69*a* (see FIGS. 3A, 3B, and 4). The lever 69Y is linked to the chuck 68Y (see FIGS. 3A and 3B). When the lever 69Y rotates from the first position to the second position, as illustrated in FIG. 3A, the chuck 68Y moves rightward while pinching a knob of the cap 34Y to detach the cap 34Y from the toner discharge port 33*a* of the container body 33Y. On the other hand, when the lever 69Y rotates from the second position to the first position, as illustrated in FIG. 3B, the chuck 68Y moves leftward to insert the cap 34Y into the toner discharge port 33*a* of the container body 33Y and release the knob of the cap 34Y. Thus, the chuck 68Y opens and closes the toner discharge port 33*a* of the toner container 32Y in conjunction with rotation of the lever 69Y.

With reference to FIGS. 5A and 5B, it can be seen that the lock 70Y engages an engagement portion 69*b* of the lever 69Y located at the first position in conjunction with an operation of drawing the toner supply unit 65Y from the body 60*a* of the toner supply device 60Y from the state in FIG. 5A to the state in FIG. 5B, thereby restricting the lever 69Y from moving (rotating) to the second position.

Specifically, when the toner supply unit 65Y is pulled out of the body 60*a* of the toner supply device 60Y and the lever 69Y is located at the first position illustrated in FIG. 5B, a boss portion 70*a* of the lock 70Y engages the engagement portion 69*b* of the lever 69Y, thereby restricting the lever 69Y from rotating to the second position illustrated in FIG. 5A. The engagement portion 69*b* is a hole disposed at a position away from the support shaft 69*a*. In the present embodiment, two sets of the boss portion 70*a* and the engagement portion 69*b* are disposed at positions apart from each other in the horizontal direction perpendicular to the unit insertion direction.

On the other hand, the lock 70Y disengages from the engagement portion 69*b* of the lever 69Y in conjunction with an operation of inserting the toner supply unit 65Y in the body 60*a* of the toner supply device 60Y like from the state in FIG. 5B to the state in FIG. 5A, thereby allowing the lever 69Y to move from the first position to the second position. Specifically, as illustrated in FIG. 5A, when the toner supply unit 65Y is set in the body 60*a* of the toner supply device 60Y, the boss portion 70*a* of the lock 70Y disengages from the engagement portion 69*b* of the lever 69Y, and the lever 69Y can rotate between the first position and the second position without restriction.

Such a configuration can prevent the lever 69Y from being erroneously rotated from the first position to the second position in a state in which the toner supply unit 65Y is drawn (removed) from the body 60*a* of the toner supply device 60Y. That is, such a configuration can prevent the toner discharge port 33*a* of the toner container 32Y from being opened (or the cap 34Y from being detached) in the state in which the toner supply unit 65Y is drawn from the body 60*a* of the toner supply device 60Y. Accordingly, toner in the toner container 32Y is prevented from leaking from the toner discharge port 33*a* unexpectedly in the state in which the toner supply unit 65Y is drawn from the body 60*a* of the toner supply device 60Y, thereby preventing the toner from staining the surrounding area.

Therefore, the configuration of the present disclosure is particularly useful because if the toner discharge port 33*a* is opened, a small amount of the toner may leak out of the toner container 32Y even when the empty toner container 32Y containing almost no toner therein is set in the toner supply unit 65Y drawn from the body 60*a* of the toner supply device 60Y, not to mention when the new toner container 32Y containing a large amount of toner therein is set in the toner supply unit 65Y drawn from the body 60*a* of the toner supply device 60Y. In the present embodiment, when the toner supply unit 65Y is set in the body 60*a* of the toner supply device 60Y and the lever 69Y does not rotate to the second position illustrated in FIG. 3A, that is, the lever 69Y remains at the first position illustrated in FIG. 3B, if an operator tries to close the body cover 140 (see FIG. 1), the body cover 140 interferes with the lever 69Y, thereby inhibiting the body cover 140 from being closed. When a normal image forming operation is performed in a state in which the toner supply unit 65Y (the toner container 32Y) is set in the body 60*a* of the toner supply device 60Y, the body cover 140 is required to be closed normally. As a result, the lever 69Y is securely located at the second position illustrated in FIG. 3A (i.e., the toner discharge port 33*a* of the toner container 32Y is securely opened). Therefore, toner is reliably supplied from the toner container 32Y to the developing device 5Y without the toner discharge port 33*a* closed.

Further, in the present embodiment, when the toner supply unit 65Y is set in the body 60*a* of the toner supply device 60Y and the lever 69Y does not rotate to the first position illustrated in FIG. 3B, that is, the lever 69Y remains at the second position illustrated in FIG. 3A, the toner supply unit 65Y is prevented from being pulled out of the body 60*a* of the toner supply device 60Y because a stopper 125 (see FIG. 7) is not released. This configuration is described in detail later with reference to FIGS. 7 to 11.

The operation of the above-described lock 70Y is described in detail below.

Figure 6:
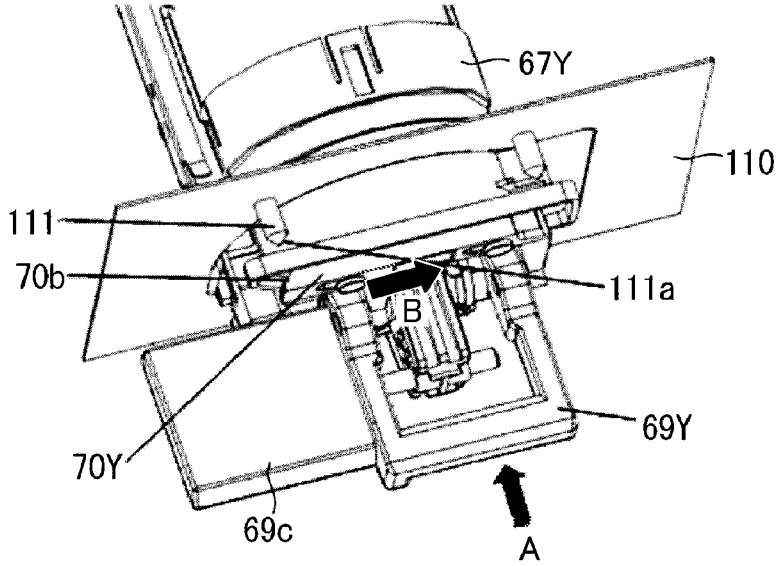
FIG. 6 is a perspective view illustrating a state immediately before the toner supply unit has been inserted into a body of the toner supply device when viewed obliquely from above.

As illustrated in FIGS. 5A, 5B, and 6, the body 60*a* of the toner supply device 60Y includes a positioning pin 111 as a positioning member to determine a position where the toner supply unit 65Y is inserted. Specifically, the positioning pin 111 is secured to a front plate 110 that is a part of the housing of the body 60*a* of the toner supply device 60Y so as to stand on toward the front side in the unit insertion direction. The front plate 110 is depicted small and simplified in FIGS. 5A, 5B, and 6 for simplicity. A casing of the toner supply unit 65Y, which holds the lock 70Y, has a positioning hole into which the positioning pin 111 disposed on the front plate 110 fits. As the positioning pin 111 on the front plate 110 fits into the positioning hole of the toner supply unit 65Y, the toner supply unit 65Y is positioned in the body 60*a* of the toner supply device 60Y.

As illustrated in FIGS. 4, 5A, and 5B, the toner supply unit 65Y includes a tension spring 71Y as a biasing member to press the lock 70Y in the direction to engage the lock 70Y with the engagement portion 69*b* indicated by the black arrow in FIGS. 5A and 5B. Specifically, the tension spring 71Y includes a hook at one end coupled to the lock 70Y, and a hook at the other end coupled to the casing that slidably holds the lock 70Y. With such a configuration, biasing force of the tension spring 71Y in the direction indicated by the black arrow in FIGS. 5A and 5B constantly acts on the lock 70Y.

The positioning pin 111 presses the lock 70Y against the biasing force of the tension spring 71Y in conjunction with the operation of inserting the toner supply unit 65Y in the body 60*a* of the toner supply device 60Y, thereby disengaging the boss portions 70*a* of the lock 70Y from the engagement portions 69*b* of the lever 69Y. That is, when the toner supply unit 65Y moves toward the body 60*a* of the toner supply device 60Y for insertion in the direction indicated by arrow A in FIG. 6, immediately before the insertion is completed, the end face of the lock 70Y contacts the circumferential face of the positioning pin 111, causing the lock 70Y to slide in the direction indicated by arrow B in FIG. 6. As a result, the boss portions 70*a* of the lock 70Y also moves in the direction indicated by arrow B in FIG. 6 and separates from the engagement portions 69*b* of the lever 69Y, and then the lever 69Y becomes freely rotatable.

On the other hand, in conjunction with the operation of drawing the toner supply unit 65Y from the body 60*a* of the toner supply device 60Y, the lock 70Y pressed by the positioning pin 111 is released and the boss portions 70*a* of the lock 70Y engage the engagement portions 69*b* of the lever 69Y by the tension spring 71Y as the biasing member. That is, when the toner supply unit 65Y is drawn (removed) from the body 60*a* of the toner supply device 60Y in the direction opposite to the direction indicated by arrow A in FIG. 6, immediately after the drawing of the toner supply unit 65Y starts, the lock 70Y separates from the circumferential face of the positioning pin 111, causing the lock 70Y to slide in the direction opposite the direction indicated by arrow B in FIG. 6. As a result, the boss portions 70*a* of the lock 70Y also move in the direction opposite to the direction indicated by arrow B in FIG. 6 and engage the engagement portions 69*b* of the lever 69Y, and thus the lever 69Y is not freely rotatable.

As described above, the positioning pin 111 has the functions of both positioning the toner supply unit 65Y with respect to the body 60*a* of the toner supply device 60Y and sliding the lock 70Y in conjunction with the inserting/drawing of the toner supply unit 65Y.

Therefore, this configuration can save space and cost of the toner supply device 60Y as compared with the case in which separate component for sliding the lock 70Y is separately provided.

Preferably, at least one of the positioning pin 111 and the lock 70Y has a chamfered (or round) portion 111*a* or 70*b* where the positioning pin 111 and the lock 70Y contact each other. Specifically, as illustrated in FIG. 6, the positioning pin 111 in the present embodiment has the chamfered portion 111*a*, which is tapered, at the portion that comes into contact with the lock 70Y. Further, the lock 70Y has the round portion 70*b*, which is rounded, at the portion that comes into contact with the positioning pin 111.

With such a configuration, when the toner supply unit 65Y moves toward the body 60*a* of the toner supply device 60Y for insertion, the positioning pin 111 and the lock 70Y contact each other along the inclined faces of the chamfered portion 111*a* and the round portion 70*b*. As a result, the lock 70Y slides smoothly in the direction indicated by arrow B in FIG. 6. When the toner supply unit 65Y is drawn from the body 60*a* of the toner supply device 60Y, the positioning pin 111 and the lock 70Y contact each other along the inclined faces of the chamfered portion 111*a* and the round portion 70*b*, so that the lock 70Y slides smoothly in the direction opposite to the direction indicated by arrow B in FIG. 6.

Figure 7:
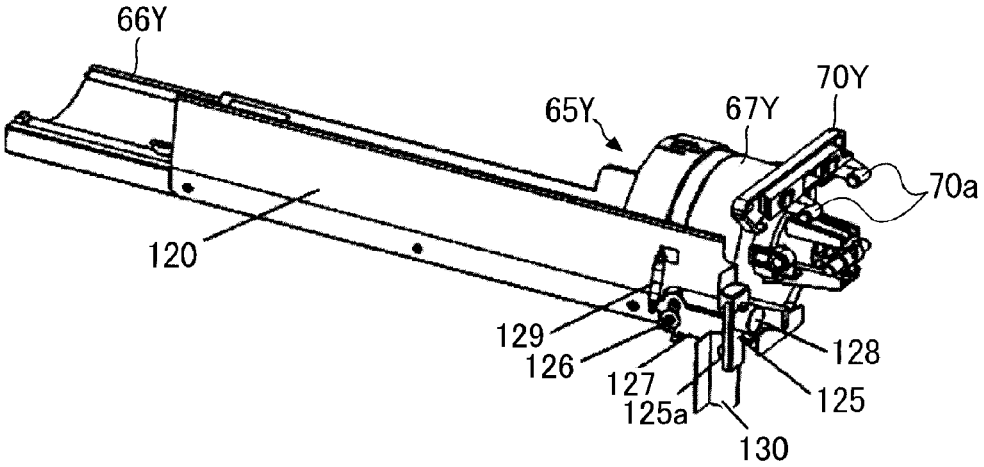
FIG. 7 is a perspective view of a part of the toner supply unit and a stopper of the toner supply device.
Figure 8A:
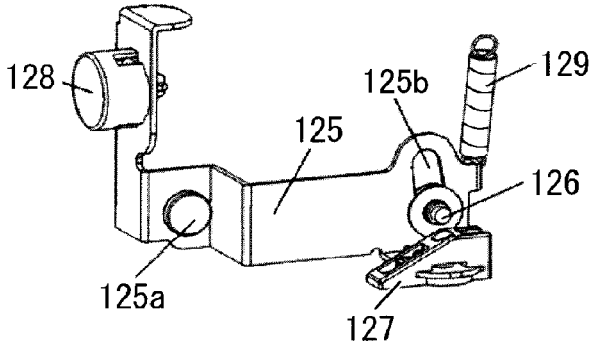
FIGS. 8A and 8B are perspective views illustrating an operation of the stopper.
Figure 8B:
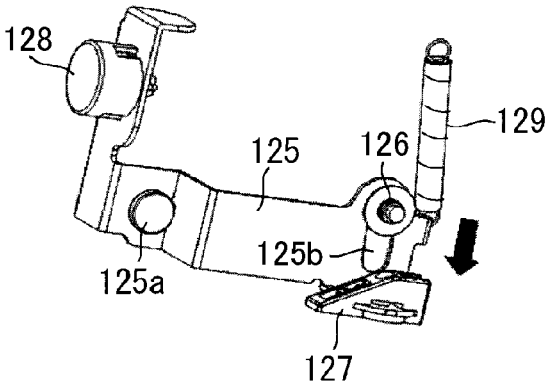
Figure 9:
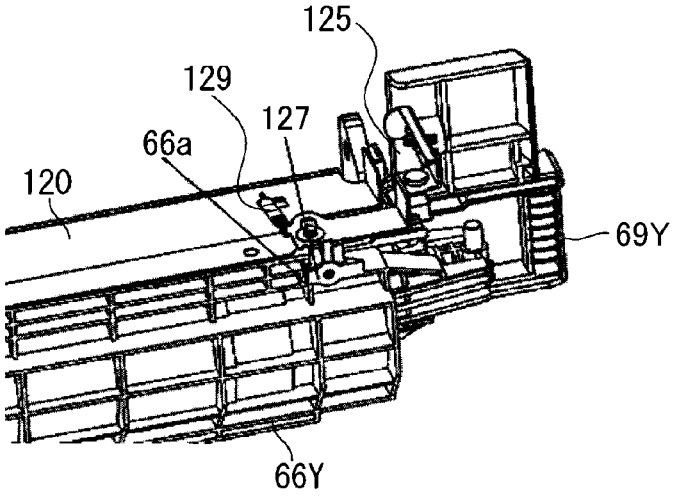
FIG. 9 is a perspective view illustrating a state in which the stopper contacts a first contact portion of the toner supply unit when viewed obliquely from below.

With reference to FIGS. 7 to 9, it can be seen that the toner supply device 60Y in the present embodiment includes the stopper 125 (mentioned above) that contacts a first contact portion 66*a* of the toner supply unit 65Y inserted into the body 60*a* of the toner supply device 60Y to restrict the toner supply unit 65Y from moving in the direction to draw (remove) the toner supply unit 65Y (hereinafter, referred to as a "unit drawing direction").

An operation button 128 as an operation portion of the stopper 125 releases the stopper 125 from contacting the first contact portion 66*a* to allow the toner supply unit 65Y to move in the unit drawing direction. That is, if an operator does not press the operation button 128 and the contact between the stopper 125 and the toner supply unit 65Y is not released, the toner supply unit 65Y is not drawn (removed) from the body 60*a* of the toner supply device 60Y like from the state illustrated in FIG. 3B to the state illustrated in FIG. 3C.

Figure 11:
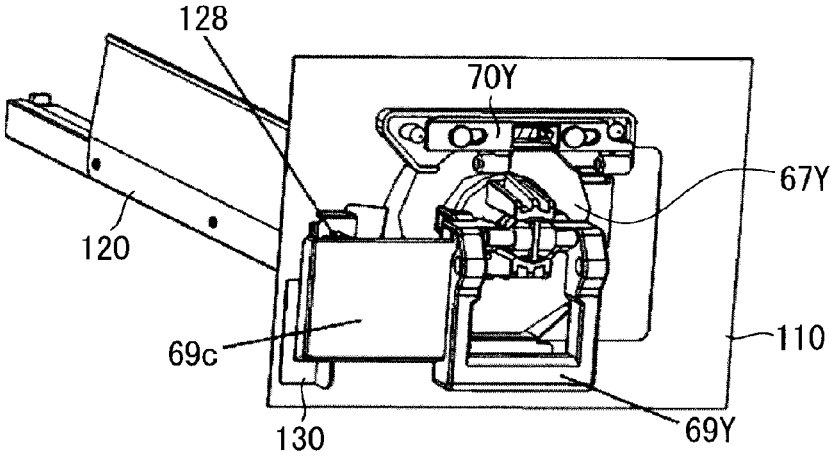
FIG. 11 is a perspective view illustrating a state in which an operation portion of the stopper is covered with a cover of the toner supply unit.

As illustrated in FIGS. 7, 8A, and 8B, the stopper 125 is supported by a bracket 130 and rotatable around a support shaft 125*a*. With reference to FIG. 11, it can be seen that the bracket 130 is secured to the front plate 110 of the body 60*a* of the toner supply device 60Y by screw or the like. The stopper 125 is a sheet metal processed with a plurality of bends and has a slot 125*b* (see FIGS. 8A and 8B) extending along an arc centered on the support shaft 125*a*. Further, the stopper 125 is provided with the operation button 128 as the operation portion made of a resin material and a contacted portion 127 made of a resin material as a single unit. A hook on one end of a tension spring 129 is coupled to the stopper 125, and a hook at the other end of the tension spring 129 is coupled to a side plate 120 (see FIG. 7) of the body 60*a*. Accordingly, the tension spring 129 biases the stopper 125 so that the contacted portion 127 contacts the first contact portion 66*a* by the tension spring 129. The side plate 120 (see FIG. 7) is provided with a stud 126 that fits into the slot 125*b* of the stopper 125, enabling the stopper 125 to rotate around the support shaft 125*a* stably. The side plate 120 also functions as a guide to guide the toner supply unit 65Y in the unit insertion/drawing direction.

As illustrated in FIG. 9, the first contact portion 66*a* is a concave portion surrounded by a rib disposed on the bottom of the container body mount 66Y on the front side in the unit insertion direction of the toner supply unit 65Y. As the contacted portion 127 of the stopper 125 engages the first contact portion 66*a*, the movement of the toner supply unit 65Y in the unit drawing direction is restricted. On the other hand, as the operation button 128 is pressed from the front side in the unit insertion direction, the stopper 125 rotates around the support shaft 125*a* in the direction indicated by the black arrow in FIG. 8B, and the engagement between the contacted portion 127 and the first contact portion 66*a* is released, thereby allowing the toner supply unit 65Y to move in the unit drawing direction.

Thus, when a user inserts the toner supply unit 65Y into the body 60*a* of the toner supply device 60Y, the user can feel a click due to the stopper 125 when the insertion is completed. Therefore, the operability at the time of inserting the toner supply unit 65Y is improved.

Figure 10:
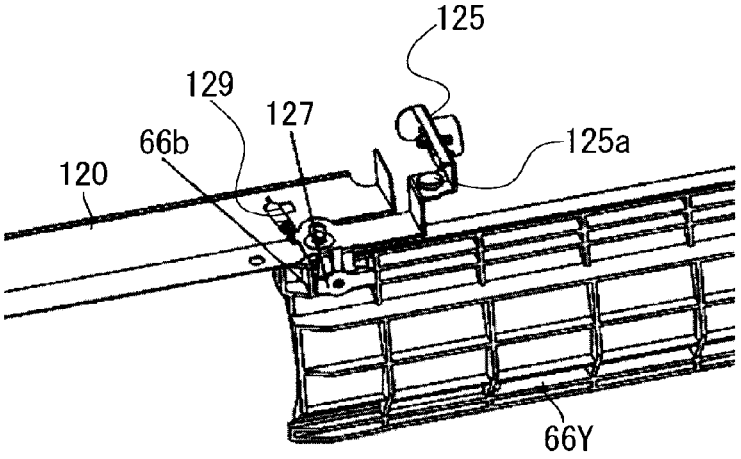
FIG. 10 is a perspective view illustrating a state in which the stopper contacts a second contact portion of the toner supply unit when viewed obliquely from below.

In the present embodiment, with reference to FIG. 10, the contacted portion 127 of the stopper 125 contacts a second contact portion 66*b* of the toner supply unit 65Y removed from the body 60*a* of the toner supply device 60Y, thereby restricting the toner supply unit 65Y from falling out of the body 60*a* of toner supply device 60Y.

More specifically, As illustrated in FIG. 10, the second contact portion 66*b* is a concave portion surrounded by the rib disposed on the bottom of the container body mount 66Y on the far side in the unit insertion direction of the toner supply unit 65Y. That is, at the bottom of the container body mount 66Y of the toner supply unit 65Y, the first contact portion 66*a* is disposed on the front side in the unit insertion direction, and the second contact portion 66*b* is disposed on the far side in the unit insertion direction. When the toner supply unit 65Y is pulled out of the body 60*a* of the toner supply device 60Y, the contacted portion 127 of the stopper 125 engages the second contact portion 66*b*. Accordingly, the toner supply unit 65Y does not exceeds the position at which the contacted portion 127 engages the second contact portion 66*b*, thereby preventing the toner supply unit 65Y from being pulled out over the position and falling out of the body 60*a*. The position at which the contacted portion 127 of the stopper 125 engages the second contact portion 66*b* is generally set to the position where an operator can removably install the toner container 32Y in the toner supply unit 65Y as illustrated in FIG. 3C.

Further, in the present embodiment, with reference to FIG. 11, in the state in which the toner supply unit 65Y is inserted into the body 60*a* of the toner supply device 60Y, as the lever 69Y moves from the first position to the second position illustrated in FIG. 11, a cover 69*c* covers the operation button 128 to disable the operation button 128. As the lever 69Y moves from the second position to the first position, the cover 69*c* exposes the operation button 128 to enable the operation button 128. In particular, the cover 69*c* in the present embodiment is formed together with the lever 69Y as a single unit having a simple configuration.

More specifically, the flat cover 69*c* is combined with the lever 69Y as a single unit and disposed adjacent to the lever 69Y. The lever 69Y is substantially U-shaped and used as the grip grasped by a user when the user pulls the toner supply unit 65Y out of the body 60*a* of the toner supply device 60Y. When the toner supply unit 65Y is set in the body 60*a* of the toner supply device 60Y and the lever 69Y is located at the second position, the operation button 128 of the stopper 125 is covered by the cover 69*c* when viewed from the front side in the unit insertion direction, thereby inhibiting the user from pressing the operation button 128. On the other hand, as the lever 69Y is rotated from the second position to the first position, the cover 69*c* is rotated in the direction to expose the operation button 128, and the user can press the operation button 128.

With such a configuration, when the toner supply unit 65Y is set in the body 60*a* of the toner supply device 60Y, if the lever 69Y is not rotated to the first position illustrated in FIG. 3B, that is, if the lever 69Y is located at the second position illustrated in FIGS. 3A and 11, the stopper 125 (the contacted portion 127) does not disengage from the first contact portion 66*a*. As a result, the toner supply unit 65Y is not pulled out of the body 60*a* of the toner supply device 60Y. Therefore, when the toner supply unit 65Y is pulled out of the body 60*a* of the toner supply device 60Y, the toner discharge port 33*a* of the toner container 32Y is sealed by the cap 34Y because the lever 69Y is rotated to the first position, thereby preventing toner from leaking from the toner discharge port 33*a*.

As described above, the toner supply device 60Y as a developer supply device according to the above-described embodiments includes the body 60*a*, the toner supply unit 65Y as a developer supply unit that is drawably insertable into the body 60*a*, and the toner container 32Y as a developer container that is removably installable in the toner supply unit 65Y and configured to contain toner as a developer. The toner supply unit 65Y includes the lever 69Y. The lever 69Y is configured to close the toner discharge port 33*a* as a developer discharge port of the toner container 32Y installed in the toner supply unit 65Y when the lever 69Y has moved to the first position, and open the toner discharge port 33*a* of the toner container 32Y installed in the toner supply unit 65Y when the lever 69Y has moved from the first position to the second position. The toner supply unit 65Y further includes the lock 70Y. The lock 70Y is configured to engage the engagement portion 69*b* of the lever 69Y in conjunction with the operation of drawing the toner supply unit 65Y from the body 60*a* to restrict the lever 69Y from moving from the first position to the second position, and disengage from the engagement portion 69*b* in conjunction with the operation of inserting the toner supply unit 65Y in the body 60*a* to allow the lever 69Y to move from the first position to the second position.

As a result, such a configuration can prevent the toner discharge port 33*a* of the toner container 32Y from being opened in the state in which the toner supply unit 65Y is drawn from the body 60*a* of the toner supply device 60Y.

According to the present disclosure, a developer supply device and an image forming apparatus incorporating the developer supply device can be provided that prevent a discharge port of a developer container from being opened when a developer supply unit is drawn from the body of the developer supply device.

It is to be noted that, although the toner container 32Y contains only toner in the above-described embodiments, alternatively, a toner container may contain a two-component developer including toner and carrier to be used in image forming apparatuses in which the two-component developer is supplied to the developing device.

In the above-described embodiments, the present disclosure is applied to the multiple toner supply devices 60Y, 60M, 60C, and 60K included in the image forming apparatus 100 that performs multicolor image formation. Alternatively, the present disclosure is also readily applicable to a toner supply device included in a monochrome image forming apparatus. In such configurations, effects similar to those described above are also attained.

The above-described embodiments are illustrative and do not limit the present disclosure. Thus, numerous additional modifications and variations are possible in light of the above teachings. The number, position, and shape of the components described above are not limited to those embodiments described above. Desirable number, position, and shape can be determined to perform the present disclosure. It is therefore to be understood that within the scope of the present disclosure, the present disclosure may be practiced otherwise than as specifically described herein.

What is claimed is:

1. A developer supply device comprising:

a body;

a developer supply unit that is drawably insertable in the body; and a developer container, configured to contain a developer, that is removably installable into the developer supply unit, the developer container including a developer discharge port, the developer supply unit including a lever and a lock:

the lever configured to:

close the developer discharge port of the developer container installed in the developer supply unit when the lever has moved to a first position; and open the developer discharge port of the developer container installed in the developer supply unit when the lever has moved from the first position to a second position, the lever including an engagement portion, the lock configured to:

engage the engagement portion in conjunction with an operation of drawing the developer supply unit from the body to restrict the lever from moving from the first position to the second position; and disengage from the engagement portion in conjunction with an operation of inserting the developer supply unit into the body to allow the lever to move from the first position to the second position.

2. The developer supply device according to claim 1, wherein the body includes a positioning member configured to position the developer supply unit when the developer supply unit has been inserted into the body, wherein the developer supply unit includes a biasing member configured to bias the lock in a direction to engage the lock with the engagement portion, and wherein the positioning member is configured to:

press the lock against biasing force of the biasing member in conjunction with the operation of inserting the developer supply unit into the body to disengage the lock from the engagement portion; and release the lock from being pressed in conjunction with the operation of drawing the developer supply unit from the body to cause the biasing member to engage the lock with the engagement portion.

3. The developer supply device according to claim 2, wherein at least one of the positioning member and the lock has a chamfered or round portion where the positioning member and the lock contact each other.

4. The developer supply device according to claim 1, wherein the developer supply unit includes a contact portion, wherein the body includes a stopper configured to contact the contact portion of the developer supply unit inserted into the body to restrict the developer supply unit from moving in a direction to draw the developer supply unit from the body, and wherein the stopper includes an operation portion configured to release the stopper from contacting the contact portion to allow the developer supply unit to move in the direction to draw the developer supply unit.

5. The developer supply device according to claim 4, wherein the developer supply unit includes another contact portion, wherein the stopper is configured to contact said another contact portion of the developer supply unit drawn from the body to restrict the developer supply unit from falling out of the body.

6. The developer supply device according to claim 4, further comprising a cover configured to:

cover the operation portion in conjunction with an operation of moving the lever from the first position to the second position to disable the operation portion; and expose the operation portion in conjunction with an operation of moving the lever from the second position to the first position to enable the operation portion.

7. The developer supply device according to claim 6, wherein the cover and the lever form a single unit.

8. An image forming apparatus comprising the developer supply device according to claim 1.

* * * * *